US006241128B1

(12) United States Patent
McClean et al.

(10) Patent No.: US 6,241,128 B1
(45) Date of Patent: Jun. 5, 2001

(54) DISPENSER PACKAGE FOR FLUENT PRODUCTS AND METHOD OF MANUFACTURE

(75) Inventors: Craig E. McClean, Kannapolis, NC (US); Robert E. Harman, Perrysburg, OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 09/219,142

(22) Filed: Dec. 22, 1998

(51) Int. Cl.[7] ..... B65D 37/00
(52) U.S. Cl. ..... 222/212; 222/494; 222/553
(58) Field of Search ..... 222/212, 494, 222/548, 553, 556

(56) References Cited

U.S. PATENT DOCUMENTS

| | | | |
|---|---|---|---|
| Re. 30,861 | 2/1982 | Krawagna | 16/293 |
| D. 204,511 | 4/1966 | Leeds et al. | D58/26 |
| D. 223,602 | 5/1972 | Hoffmann | D9/1 |
| D. 224,092 | 7/1972 | Steidley | D9/258 |
| D. 236,880 | 9/1975 | Sway | D9/1 |
| D. 245,225 | 8/1977 | Lyons | D9/1 |
| D. 325,164 | 4/1992 | Cann et al. | D9/377 |
| D. 353,332 | 12/1994 | Behm et al. | D9/529 |
| 1,033,688 | 7/1912 | Fuchs . | |
| 1,033,689 | 4/1912 | Fuchs . | |
| 1,102,302 | 7/1914 | Slade . | |
| 1,173,546 | 2/1916 | Baron . | |
| 1,666,743 | 4/1928 | Klopsteg . | |
| 1,861,602 | 6/1932 | Koze . | |
| 1,925,926 | 9/1933 | Kunkel | 222/494 |
| 2,272,867 | 2/1942 | Cobel | 65/31 |
| 2,312,380 | 3/1943 | Bernhardt | 65/31 |
| 2,361,958 | 11/1944 | Nyden | 222/556 |
| 2,391,345 | 12/1945 | Punte | 222/517 |
| 2,474,678 | 6/1949 | Kitchen | 65/57 |
| 2,484,148 | 10/1949 | Beatty et al. | 222/196.2 |
| 2,574,422 | 11/1951 | Stoos, Jr. et al. | 222/517 |
| 2,575,106 | 11/1951 | Hermani | 222/517 |
| 2,694,511 | 11/1954 | Bogaus et al. | 222/491 |

(List continued on next page.)

FOREIGN PATENT DOCUMENTS

| | | |
|---|---|---|
| 1611976 | 6/1972 | (DE) . |
| 2120079 | 11/1972 | (DE) . |
| 8403711 | 5/1985 | (DE) . |
| 8815614 | 2/1989 | (DE) . |
| 0591601 | 4/1994 | (EP) . |
| 2317180 | 7/1975 | (FR) . |
| 8618500 | 12/1986 | (FR) . |
| 856523 | 12/1960 | (GB) . |
| 1228957 | 4/1971 | (GB) . |
| 4771 | 12/1976 | (GB) . |

OTHER PUBLICATIONS

Photographs labeled "A" through "G", each showing three closure specimens Seaquist Closures Publications (2 sides) C–044/5M entitled "Disc Top Dispennsing Closures", 1986.

*Primary Examiner*—Joseph A. Kaufman

(57) ABSTRACT

A dispenser package for fluent products such as cosmetics and lotions that includes an integrally molded plastic container having a flexible body with a sidewall, a closed bottom, and a top wall having a dispensing opening offset from the axis of the container body. A closure has a base wall and a peripheral skirt. In some embodiments of the invention, the closure is rotatably mounted on the container body, and has a dispensing opening in the closure base wall for selective registry with the dispensing opening in the top wall of the container body. Detent elements are provided on the closure and container body for selectively locking the closure in open and closed positions. In alternative embodiments, the closure includes a flip-top hinged to the base wall, with a plug extending therefrom for selectively opening and closing the dispensing opening in the container body top wall.

53 Claims, 9 Drawing Sheets

U.S. PATENT DOCUMENTS

| | | | |
|---|---|---|---|
| 2,762,537 | 9/1956 | Reinhardt, Jr. | 222/537 |
| 2,808,183 | 10/1957 | Olson et al. | 222/498 |
| 2,812,120 | 11/1957 | Beall, Jr. | 222/481.5 |
| 2,815,154 | 12/1957 | Smith | 222/452 |
| 2,894,660 | 7/1959 | Gordon | 222/108 |
| 2,961,133 | 11/1960 | Ankney | 222/548 |
| 3,042,273 | 3/1962 | Bauer | 222/548 |
| 3,078,497 | 2/1963 | Micallef | 222/209 |
| 3,094,256 | 6/1963 | Ensch | 222/536 |
| 3,131,824 | 5/1964 | Van Baarn | 215/41 |
| 3,135,441 | 6/1964 | Wise et al. | 222/541 |
| 3,140,019 | 7/1964 | Barr | 222/556 |
| 3,157,322 | 11/1964 | Bernhardt | 222/517 |
| 3,201,011 | 8/1965 | Brocken | 222/473 |
| 3,251,509 | 5/1966 | Foster | 222/153 |
| 3,252,632 | 5/1966 | Hagenes | 222/449 |
| 3,262,606 | 7/1966 | Waterman | 222/556 |
| 3,300,104 | 1/1967 | Burt | 222/482 |
| 3,302,835 | 2/1967 | Eckles | 222/565 |
| 3,303,971 | 2/1967 | Stevens, Jr. | 222/153 |
| 3,371,827 | 3/1968 | Micallef | 222/507 |
| 3,377,005 | 4/1968 | Marder | 222/402.13 |
| 3,383,019 | 5/1968 | Waterman | 222/565 |
| 3,400,566 | 9/1968 | Fattori | 222/511 |
| 3,429,488 | 2/1969 | Micallef | 222/570 |
| 3,469,739 | 9/1969 | Phillips | 221/96 |
| 3,471,066 | 10/1969 | Micallef | 222/519 |
| 3,484,027 | 12/1969 | Micallef | 222/554 |
| 3,516,581 | 6/1970 | Micallef | 222/529 |
| 3,539,075 | 11/1970 | Bautista | 222/531 |
| 3,542,256 | 11/1970 | Waterman | 222/484 |
| 3,642,179 | 2/1972 | Micallef | 222/402.12 |
| 3,653,546 | 4/1972 | Hazzard | 222/83 |
| 3,659,756 | 5/1972 | Lancaster | 222/531 |
| 3,675,804 | 7/1972 | Micalif | 215/9 |
| 3,675,812 | 7/1972 | Foster | 220/337 |
| 3,702,165 | 11/1972 | Carow et al. | 222/153 |
| 3,718,239 | 2/1973 | Cochran | 222/548 |
| 3,734,359 | 5/1973 | Waterman | 222/484 |
| 3,771,685 | 11/1973 | Micallef | 215/9 |
| 3,773,232 | 11/1973 | Hidding | 222/480 |
| 3,785,528 | 1/1974 | Mandeltort | 222/148 |
| 3,847,313 | 11/1974 | Micallef | 222/507 |
| 3,853,250 | 12/1974 | Alpern | 222/517 |
| 3,872,996 | 3/1975 | Dogliotti | 222/254 |
| 3,927,805 | 12/1975 | Stull | 222/153 |
| 3,948,422 | 4/1976 | Micallef | 222/517 |
| 3,957,181 | 5/1976 | Hazzard | 222/534 |
| 3,966,080 | 6/1976 | Bittel | 220/269 |
| 3,967,764 | 7/1976 | Hazzard | 222/536 |
| 4,006,836 | 2/1977 | Micallef | 215/218 |
| 4,015,756 | 4/1977 | Beck | 222/534 |
| 4,022,352 | 5/1977 | Pehr | 222/153 |
| 4,106,672 | 8/1978 | Tecco et al. | 222/151 |
| 4,158,902 | 6/1979 | Chernack et al. | 16/150 |
| 4,219,138 | 8/1980 | Hazard | 222/534 |
| 4,220,248 | 9/1980 | Wilson et al. | 215/235 |
| 4,291,818 | 9/1981 | Nozawa et al. | 220/335 |
| 4,301,949 | 11/1981 | Palson et al. | 222/548 |
| 4,308,979 * | 1/1982 | Otterson | 222/548 |
| 4,343,397 | 8/1982 | Nozawa et al. | 206/37 |
| 4,358,032 | 11/1982 | Libit | 222/498 |
| 4,371,095 | 2/1983 | Montgomery et al. | 222/153 |
| 4,377,247 | 3/1983 | Hazard et al. | 222/517 |
| 4,399,928 | 8/1983 | Klinger | 220/335 |
| 4,441,637 | 4/1984 | Libit | 222/556 |
| 4,487,342 | 12/1984 | Shy | 222/481.5 |
| 4,545,508 | 10/1985 | Cribb, Jr. et al. | 222/153 |
| 4,579,260 | 4/1986 | Young et al. | 222/465 R |
| 4,583,667 * | 4/1986 | Fishman et al. | 222/553 |
| 4,598,839 | 7/1986 | Dombroski et al. | 222/92 |
| 4,625,898 | 12/1986 | Hazard | 222/517 |
| 4,645,086 | 2/1987 | Rosenthal | 215/235 |
| 4,678,107 | 7/1987 | Ennis, III | 222/386.5 |
| 4,732,303 | 3/1988 | Wang | 222/484 |
| 4,776,501 | 10/1988 | Ostrowsky | 222/517 |
| 4,782,985 * | 11/1988 | Kinsley | 222/556 |
| 4,793,502 | 12/1988 | Beck | 222/235 |
| 4,815,616 | 3/1989 | Silvenis | 215/232 |
| 4,838,460 | 6/1989 | Moore et al. | 222/153 |
| 4,848,601 | 7/1989 | Reil | 222/528 |
| 4,861,541 | 8/1989 | Kaminski et al. | 425/503 |
| 4,911,635 | 3/1990 | Kaminski et al. | 425/503 |
| 4,962,869 | 10/1990 | Gross et al. | 222/153 |
| 4,978,035 | 12/1990 | Morane et al. | 222/108 |
| 4,982,882 | 1/1991 | Gueret | 222/531 |
| 5,022,566 | 6/1991 | Song et al. | 222/480 |
| 5,022,567 | 6/1991 | Frazer | 222/475 |
| 5,052,595 | 10/1991 | Mon | 222/525 |
| 5,054,662 | 10/1991 | Santagiuliana | 222/531 |
| 5,058,775 | 10/1991 | Gross et al. | 222/153 |
| 5,065,912 | 11/1991 | Rosenthall | 222/517 |
| 5,105,989 | 4/1992 | Gutkowski | 222/182 |
| 5,123,561 | 6/1992 | Gross | 222/254 |
| 5,147,072 | 9/1992 | Dirksing | 222/212 |
| 5,192,005 | 3/1993 | Zimmerman | 222/148 |
| 5,193,704 | 3/1993 | Kick | 220/253 |
| 5,201,440 | 4/1993 | Gross | 222/153 |
| 5,213,235 | 5/1993 | Miranda | 222/107 |
| 5,236,107 | 8/1993 | Spaanstra, Sr. | 222/534 |
| 5,242,079 | 9/1993 | Stephens et al. | 220/705 |
| 5,259,538 | 11/1993 | Tardif | 222/528 |
| 5,279,451 | 1/1994 | Mueller et al. | 222/507 |
| 5,284,264 | 2/1994 | Gross | 215/237 |
| 5,314,093 | 5/1994 | Gross et al. | 222/153 |
| 5,341,960 | 8/1994 | Lay | 222/153 |
| 5,346,100 | 9/1994 | Lay | 222/153 |
| 5,370,277 | 12/1994 | Wallis | 222/153 |
| 5,370,284 | 12/1994 | Dirksing | 222/534 |
| 5,377,882 | 1/1995 | Pham et al. | 222/479 |
| 5,482,172 | 1/1996 | Braddock | 215/235 |
| 5,544,790 | 8/1996 | Lu | 222/212 |
| 5,566,850 * | 10/1996 | Forsyth et al. | 222/548 |
| 5,579,961 | 12/1996 | Zimmerman | 222/545 |
| 5,730,322 * | 3/1998 | Iba et al. | 222/212 |
| 5,769,253 * | 6/1998 | Gross | 222/556 |

* cited by examiner

DISPENSER PACKAGE FOR FLUENT PRODUCTS AND METHOD OF MANUFACTURE

The present invention is directed to dispenser packages for fluent products such as cosmetics and body lotions, and more particularly to a dispenser package and method of manufacture in which the dispensing closure is closely integrated in contour and structure with the body of the package container.

BACKGROUND AND SUMMARY OF THE INVENTION

It is a general object of the present invention to provide a dispenser package and method of manufacture for fluent products, such as cosmetics and lotions, which obtain reduced manufacturing and inventory costs by reducing the number and complexity of component parts and/or by improved ease of assembly. Another and related object of the present invention is to provide a dispenser package and method of manufacture having improved visual impact in terms of blending the closure structurally and by contour more closely with the design of the package container body. Yet another object of the present invention is to provide a dispenser package and method of manufacture having a low-profile closure and, consequently, increased panel area, for application of labeling to the container body.

A dispenser package for a fluent product in accordance with one aspect of the present invention includes an integrally molded plastic container having a body with a sidewall, a closed bottom, and a top wall with at least one opening offset from the axis of the container body. A circumferential exterior channel extends around the sidewall of the container body adjacent to the top wall. A closure has a base wall, a peripheral skirt, and a rib that extends radially inwardly from the skirt for slidable receipt in the channel to mount the closure on the container body for rotation about the axis of the body. The closure has an opening for registry with the offset opening in the top wall of the container body for dispensing product from the package. Detent elements are provided on the base wall of the closure and the top wall of the container for releasably locking the closure to the container with the opening in the closure in registry with the opening in the container for dispensing product.

In the preferred embodiments in accordance with this aspect of the invention, these detent elements include an elevated plateau on the top wall of the container surrounding the dispensing opening, and an annular collar depending from the closure top wall surrounding the opening in the top wall for releasable locking registry with the plateau on the container. The plateau preferably has an angulated sidewall for camming the collar into and out of locking registry with the plateau as the closure is rotated on the container. The closure preferably also has a lug in the form of a depression in the base wall angularly spaced from the opening in the closure base wall for releasable locking engagement with the opening in the top wall of the container body to lock the closure with respect to the container body with the opening in the closure out of registry with the dispensing opening in the container. In this way, the closure may be releasably locked with respect to the container body both with the openings in registry for dispensing product, and with the openings out of registry to prevent dispensing of product.

In some preferred embodiments of the invention, the container top wall has an opening centered on the axis of the container body that is of larger diameter than the offset dispensing opening. This central opening is surrounded by a wall that extends axially outwardly from the container top wall terminating in a radial bead, and the closure base wall has an axially and radially inwardly extending bead for sliding receipt by snap fit over the radial bead on the top wall. The closure base wall preferably further includes an annular wall spaced radially inwardly from the bead for sliding internal sealing engagement with the axial wall on the container top wall. A check valve may be mounted in the dispensing opening in the container top wall. The dispensing opening in the closure may extend axially through the closure base wall, or may comprise an axial portion for registry with the dispensing opening in the container top wall and a radial portion that extends through the closure base wall to the skirt. A circumferential array of axial ribs may be provided around the outer surface of the closure skirt to facilitate gripping and rotation of the closure on the container body.

A dispenser package for a fluent product in accordance with another aspect of the present invention includes an integrally molded plastic container having a body with a sidewall on a central axis, a closed bottom and a top wall having a first opening centered on the axis and at least one second opening offset from the axis. A closure has a base wall and a peripheral skirt. The base wall of the closure has an annular axially extending wall with interlocking means for engaging the first opening in the top wall of the container body to mount the closure on the container, and means for selectively opening and closing the dispensing opening in the container body. The closure may be non-rotatably mounted on the container body and include a flip-top hinge to the closure. The flip-top closure may cover the top of the container body, or may be mounted in a recessed pocket on the top of the container body for closely matching the peripheral and axial contours of the container body. The flip top preferably has a plug for engagement within the dispensing opening on the container body top wall to seal the dispenser opening when the flip top is closed. Alternatively, the closure may be rotatably mounted on the container body, with an opening in the base wall of the closure offset from the axis of the container body for selective registry with the dispensing opening in the container body as previously discussed.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
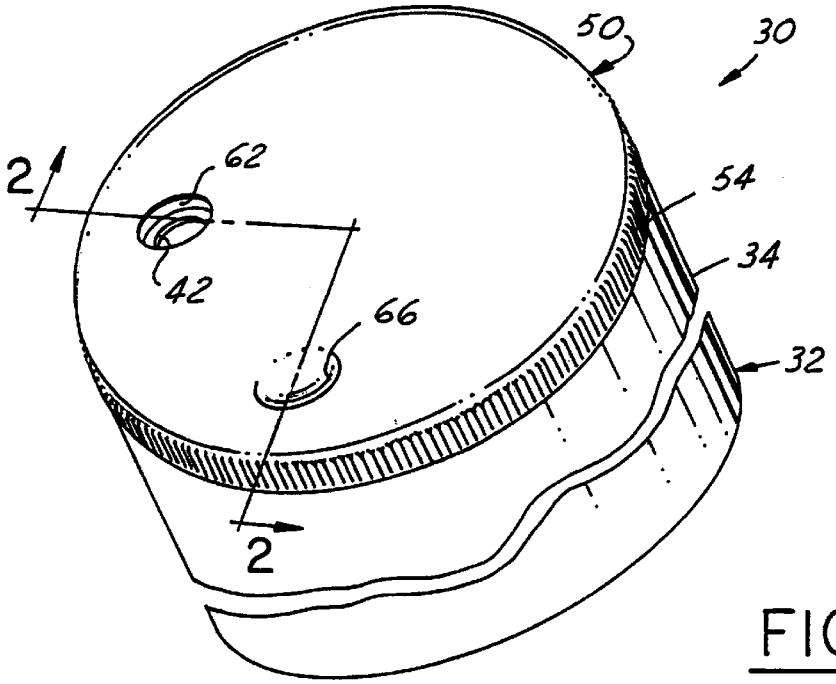
FIG. 1 is a broken perspective view of a dispenser package for fluent products in accordance with one presently preferred embodiment of the invention.
Figure 2:
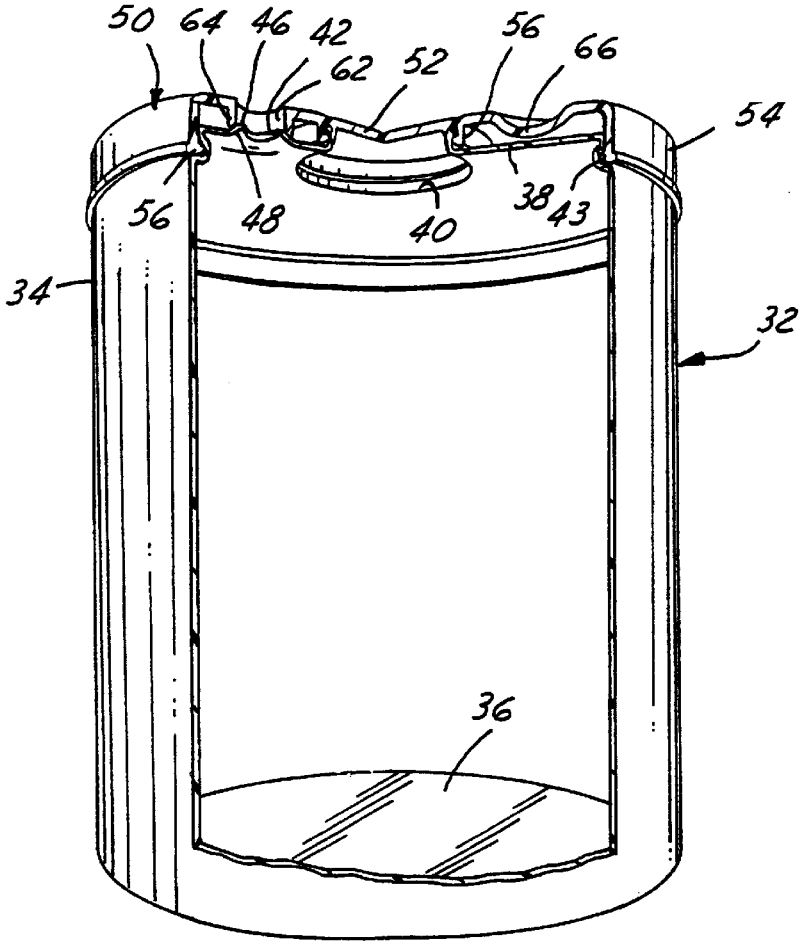
FIG. 2 is a sectional view taken substantially along the line 2—2 in FIG. 1.
Figure 3:
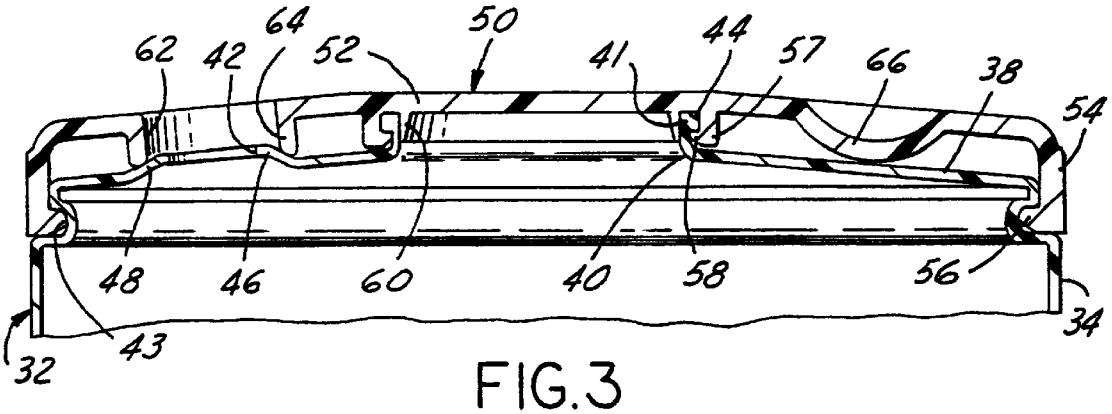
FIG. 3 is a fragmentary sectional view of the top portion of FIG. 2 on an enlarged scale showing the dispenser package with the dispensing openings in registry.
Figure 3A:
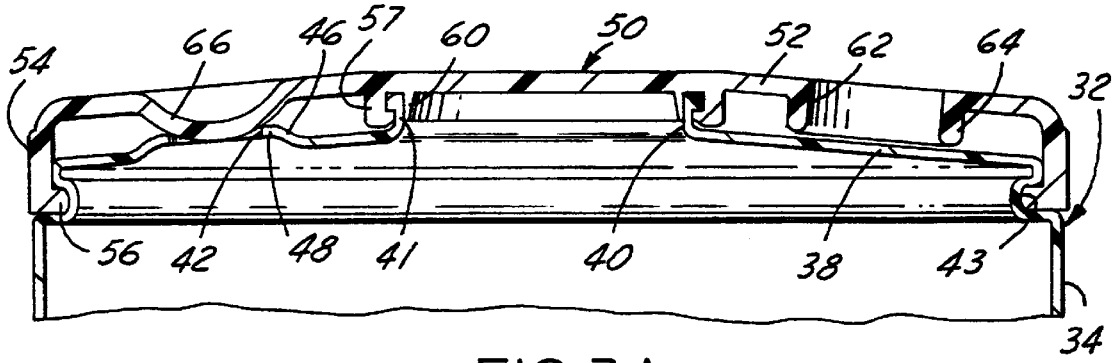
FIG. 3A is a view similar to that of FIG. 3 but showing the dispensing openings closed.

FIGS. 1–3A illustrate a dispenser package 30 for fluent products, such as cosmetics and lotions, in accordance with one presently preferred embodiment of the invention. Package 30 includes an integrally molded plastic container 32 having a flexible body with a sidewall 34, a closed bottom 36 and a top wall 38. In the embodiment illustrated in FIGS. 1–3A, sidewall 34 is cylindrical throughout its length. However, it will be understood that, in accordance with this aspect of the invention, only the upper portion of the interior body that rotatably receives the closure need be round, preferably cylindrical. The lower portion of the body can be rectangular, oval or any other desired shape. Top wall 38 tapers upwardly and inwardly, having an enlarged circular center opening 40 coaxial with the axis of sidewall 34, and at least one circular opening 42 offset from the axis of the sidewall. A circumferentially continuous channel 43 extends around sidewall 34 adjacent to top wall 38. As best seen in FIGS. 3 and 3A, center opening 40 in container top wall 38 is bounded and defined by a circumferentially continuous wall 41 that extends axially upwardly from wall 38 coaxially with sidewall 34. Wall 41 terminates in a radially outwardly extending circumferentially continuous rib or bead 44. Offset opening 42 is disposed in a raised plateau 46 contiguous with and offset from container top wall 38, being connected thereto by an upwardly tapering conical wall 48.

A closure 50 is rotatably mounted on container 32 to form dispenser package 30. Closure 50 includes a circular base wall 52 from which a peripheral skirt 54 integrally depends. A circumferential array of axially extending ribs are formed on the outer periphery of skirt 54 for enhanced gripping to rotate closure 50 on container 32. Base wall 52 of closure 50 is parallel to and uniformly spaced from top wall 38 of container 32. A circumferentially continuous rib or bead 56 extends radially inwardly from the free end of skirt 54 remote from base wall 52, and is received by sliding snap fit within channel 43 on sidewall 34. A circumferentially continuous annular wall 57 depends from the central portion of closure base wall 52 surrounding wall 42 and bead 44 in assembly. A circumferentially continuous rib or bead 58 projects radially inwardly from the free end of wall 57, and is received by snap fit in assembly beneath bead 44 on wall 41. A second annular wall 60 depends from base wall 52 of closure 50 spaced radially inwardly from wall 57 so as to be received in sliding engagement within the inside diameter of wall 41 and form a plug seal with respect to wall 41. A circular dispensing opening 62 is formed in closure base wall 52 at a position radially offset from the axis of closure 50 by an amount corresponding to the offset of opening 42 in container top wall 38 from the axis of container sidewall 34. Opening 62 is surrounded and defined by an annular collar 64 that extends inwardly from closure base wall 52. The rounded free edge of collar 64 lies in a plane parallel to container top wall 38, as best seen in FIG. 3A. Opening 62 and wall 64 have an inside diameter corresponding to the outer diameter of conical wall 48 of plateau 46 in container top wall 38. A lug 66 is formed as a part-spherical depression in base wall 52 of closure 50 at a position radially offset from the axis of closure 50 by a distance corresponding to the radial offset of plateau 46 and opening 42 in container 32. The outer diameter of closure skirt 54 is the same as the outer diameter of sidewall 34 so that the closure periphery blends with the container sidewall.

Container 32 and closure 50 preferably are of plastic composition of any suitable type, and may be formed in any suitable molding operation. It is presently preferred that container 32 be of polyethylene composition, and that closure 50 be of polypropylene composition. With closure 50 separate from container 32, container 32 is filled with product through center opening 40 defined by wall 41. After filling, closure 50 is assembled to container 32 by snapping bead 58 of wall 57 over bead 44 of wall 41, and by snapping bead 56 of peripheral wall 54 into channel 43 of container sidewall 34. For shipment and storage, closure 50 is circumferentially positioned with respect to container 32 such that depression 66 on closure base wall 52 registers and aligns with dispensing opening 42 in container top wall 38, as shown in FIG. 3A, thereby closing the dispenser package. To dispense product from within the package, closure 50 is rotated about the axis of container 32. Initial rotation cams depression 66 out of opening 42 and down conical wall 48 of plateau 46 as container top wall 38 flexes axially inwardly. Continued rotation brings the lower edge of wall 64 into camming engagement with conical wall 48 of plateau 46, whereby wall 38 is cammed downwardly until plateau 46 aligns or registers with closure wall 64. At this point, cooperative engagement between plateau 46 on container top wall 38 and wall 64 on closure base wall 52 releasably locks the closure in position so that product may be dispensed from within the package by squeezing the sidewall of container 34. The sidewall 34 of container 32 is sufficiently thin to permit such flexure, and reassumes the initial configuration illustrated in the drawings when the squeezing forces have been released. To close package 30, closure 50 is rotated in the opposite direction, initially flexing plateau 46 inwardly and moving closure wall 64 out of registry therewith, and subsequently again flexing plateau 46 inwardly and moving depression 66 into sealing registry with dispensing opening 42.

Figure 4:
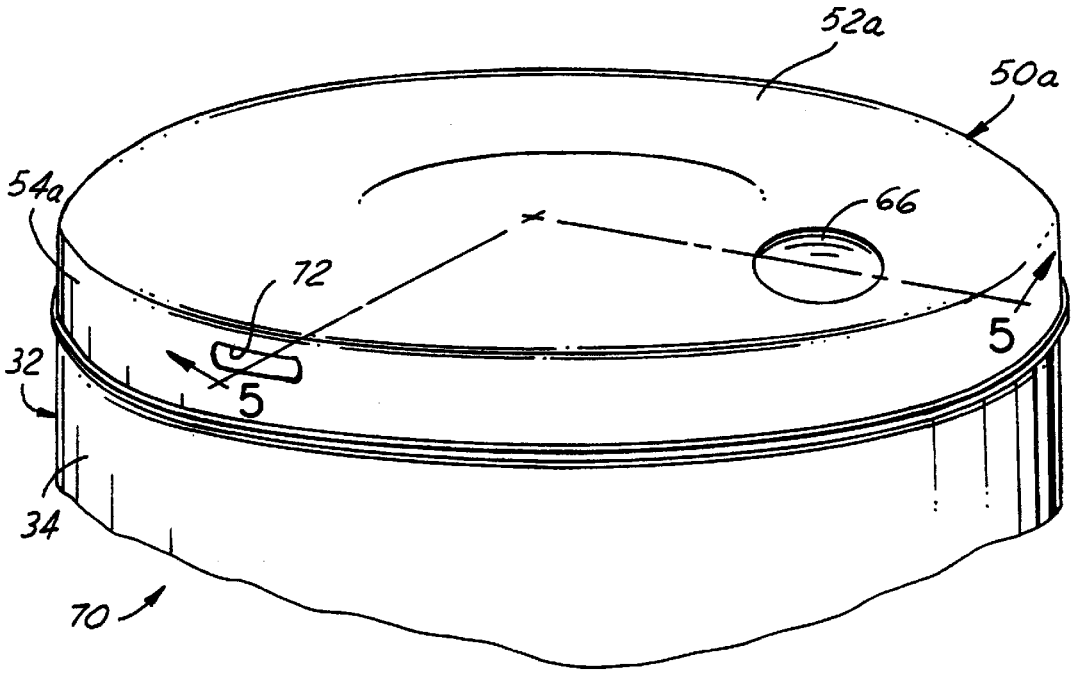
FIG. 4 is a fragmentary perspective view of a dispenser package in accordance with a modified embodiment of the invention.
Figure 5:
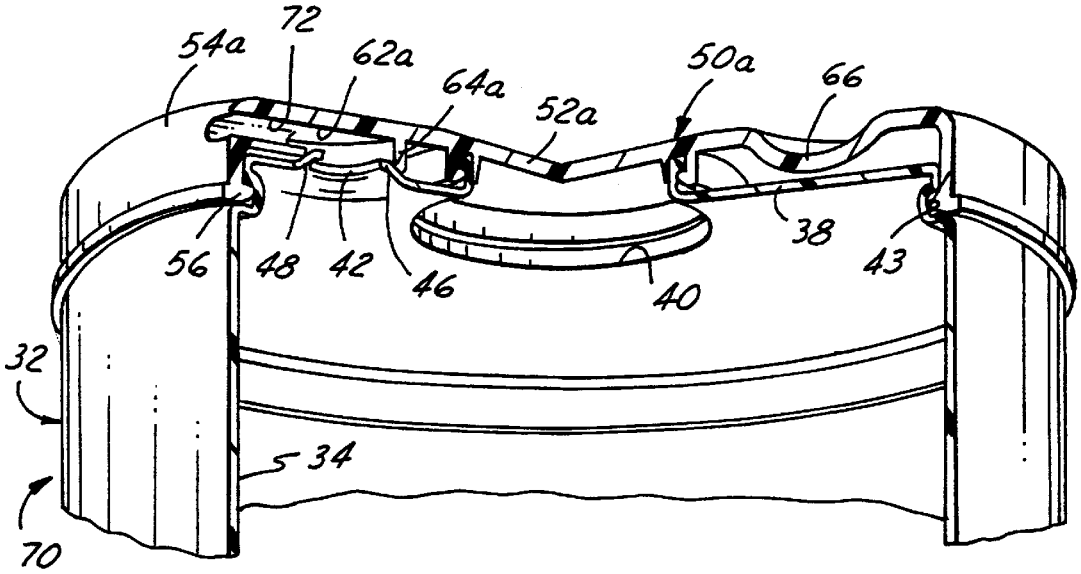
FIG. 5 is a fragmentary perspective sectional view taken substantially along the line 5—5 in FIG. 4.

FIGS. 4–21 illustrate various modified embodiments of the invention, in which identical reference numerals indicate identical components, and reference numerals with a letter suffix indicate modified but functionally similar components. FIGS. 4 and 5 illustrate a dispenser package 70, which is basically similar to package 30 of FIGS. 1–3A except in the configuration of the dispenser opening 62*a* in closure 50*a*. Closure dispensing opening 62*a* has an axial portion defined by an annular closure wall 64*a*, and a portion 72 that extends radially through base wall 52*a* of closure 50*a*. Thus, product is dispensed radially in the embodiment 70 of FIGS. 4 and 5 through the peripheral wall 54*a* of closure 50*a*.

Figure 6:
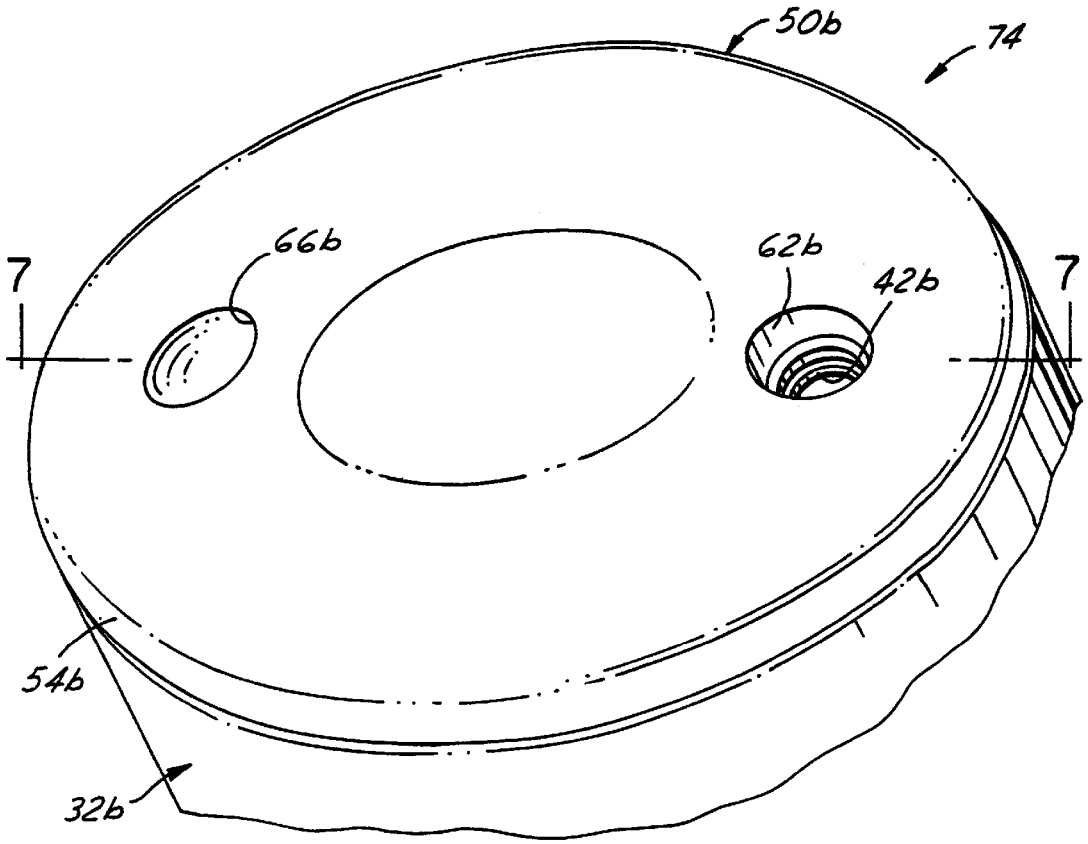
FIG. 6 is a fragmentary perspective view of a dispenser package in accordance with another embodiment of the invention.
Figure 7:
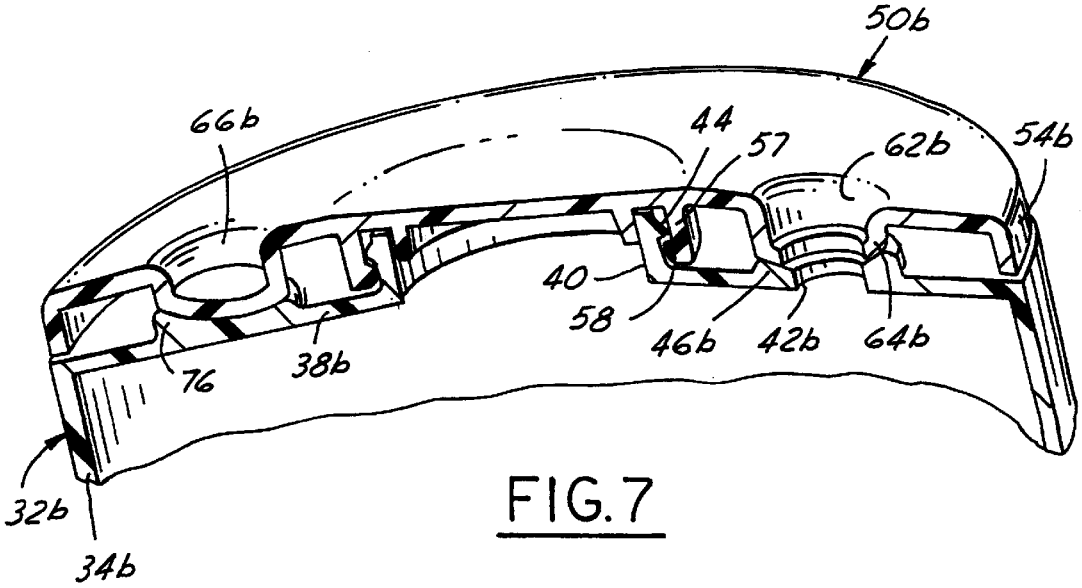
FIG. 7 is a fragmentary sectional view taken substantially along the line 7—7 in FIG. 6.

FIGS. 6 and 7 illustrate a dispenser package 74 in which dispensing opening 62*b* and detent depression 66*b* are on diametrically opposed sides of the axis of closure 50*b*, rather than at 90° spacing from each other as in the embodiments of FIGS. 1–5. Top wall 38*b* of container 32*b* includes an upwardly facing pocket 76 for registry with depression 66*b* in the open position of pocket 74 illustrated in FIG. 7, and for registry with wall 64*b* in the closed position of the dispenser. Thus, both plateau 46*b* surrounding dispensing opening 42*b* in container 32*b* and pocket 76 cooperate with both depression 62*b* and annular wall 64*b* surrounding dispensing opening 62*b* in closure 50*b* releasably to lock the closure in both the dispensing and non-dispensing positions of the closure. Base wall 52*b* of closure 50*b* has a peripheral skirt 54*b* that is either spaced from or in sliding engagement with the opposed axial surface of wall 38*b*. Thus, closure 50*b* is retained on container 32*b* solely by the interlocking beads 44, 58 at center opening 40.

Figure 8:
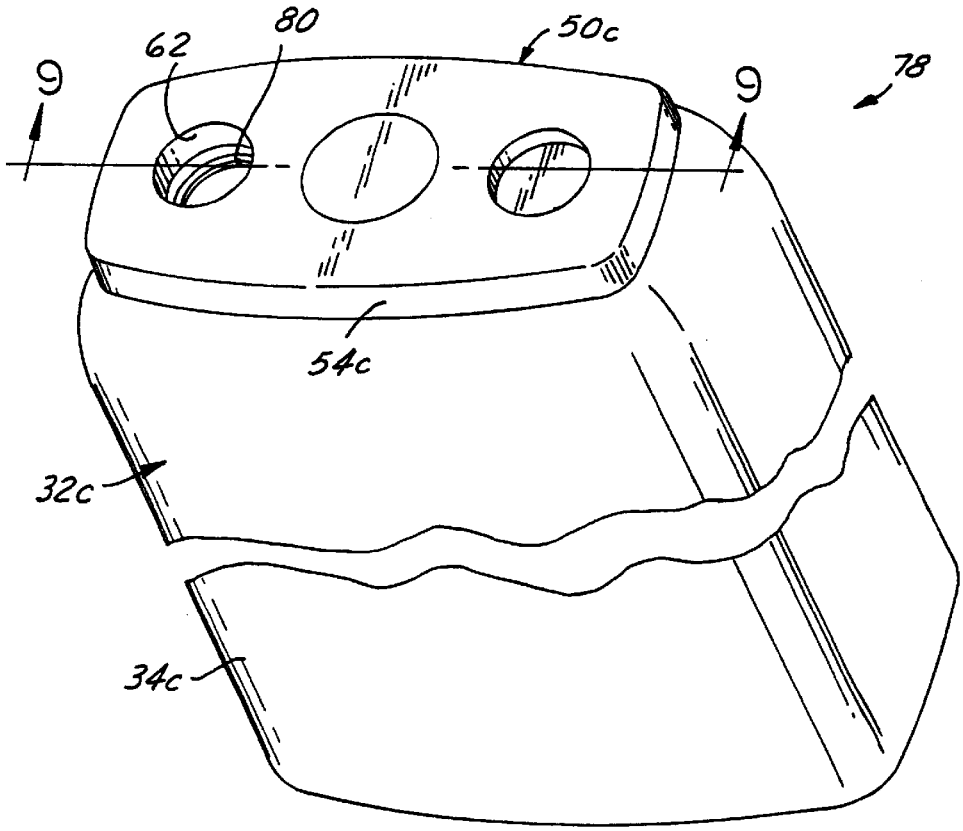
FIG. 8 is a broken perspective of a dispenser package in accordance with yet another embodiment of the invention.
Figure 9:
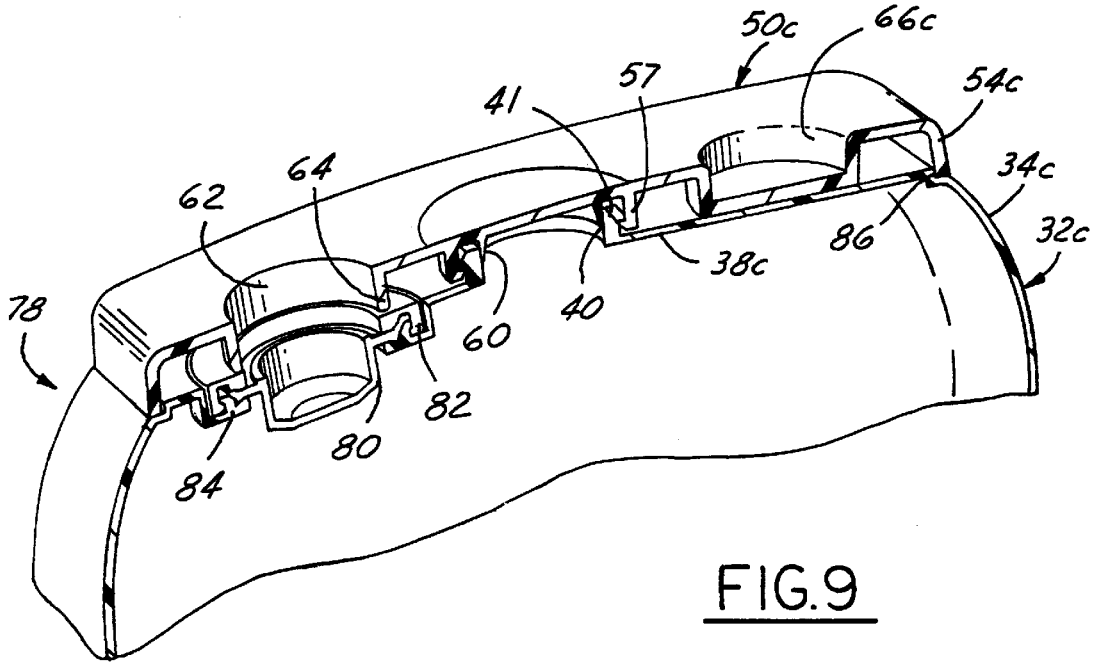
FIG. 9 is a fragmentary sectional view taken substantially along the line 9—9 in FIG. 8.

FIGS. 8 and 9 illustrate a dispenser package 78 of generally oval cross section, as distinguished from the circular cross section of the dispenser packages illustrated in FIGS. 1–7. Closure 50*c* is rotatably secured to annular wall 41 of container top wall 38*c* in the manner previously described. A resilient check valve 80 is captured by a ring 82 that snaps into a beaded depression 84 that defines the dispensing opening in container top wall 38*c*. The upper surface of valve-retaining ring 82 is flat. A depression 66*c* is again formed in closure 50*c* at a position diametrically opposed to dispensing opening 62. However, wall 64 defining dispensing opening 62, and depression 66 do not function as detent locking means in this embodiment, but merely register with ring 82 either to open dispensing valve 84 in the position shown in FIG. 9, or to close the dispensing opening in the position 180° from that shown in FIGS. 8 and 9. In this embodiment, the peripheral edge of closure skirt 54*c* registers with a shoulder 86 defined around the periphery of container sidewall 34*c* releasably to hold closure 50*c* in either the open or the closed position. When the closure is rotated with respect to the container body, the container sidewall flexes downwardly so as to free the closure for rotation until the closure is rotated 180°, at which point the container sidewall flexes outwardly again releasably to lock the closure in position. Valve 80 may be of any suitable configuration. One presently preferred embodiment of valve 80 is illustrated in U.S. application Ser. No. 08/746,521 filed Nov. 12, 1996 and incorporated herein by reference.

Figure 10:
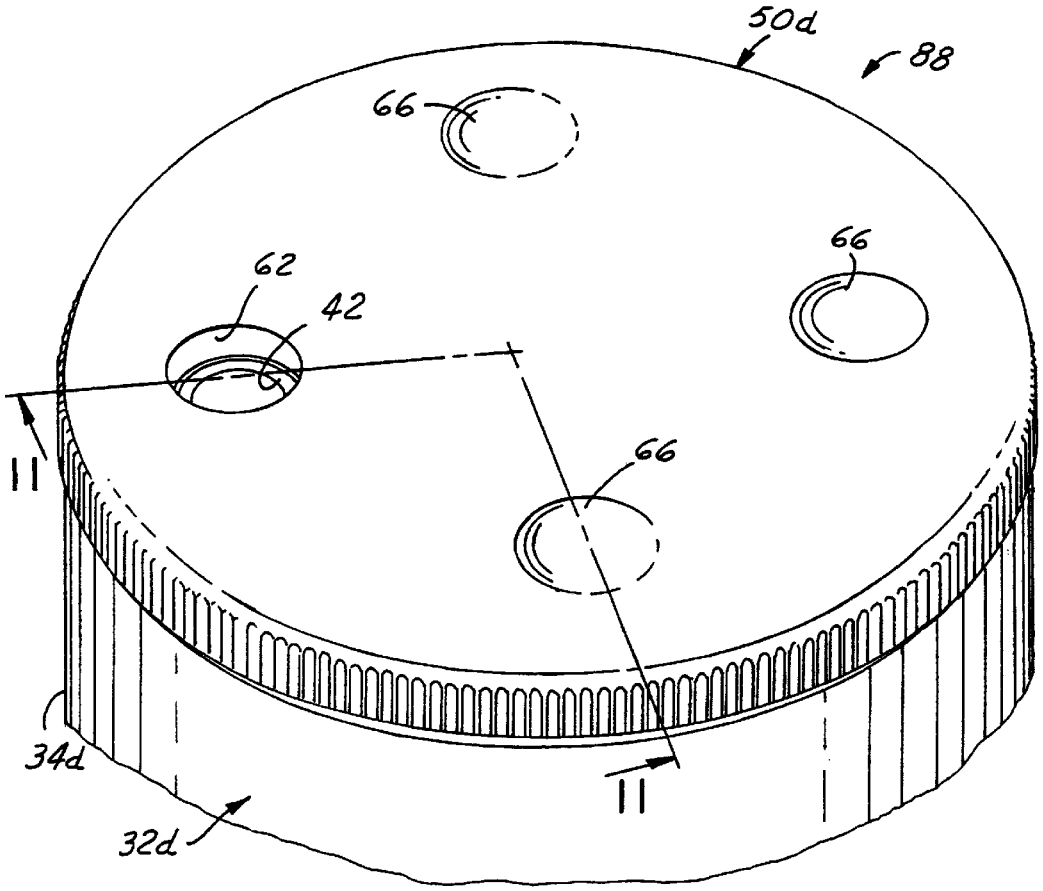
FIG. 10 is a fragmentary perspective view of a dispenser package in accordance with a further embodiment of the invention.
Figure 11:
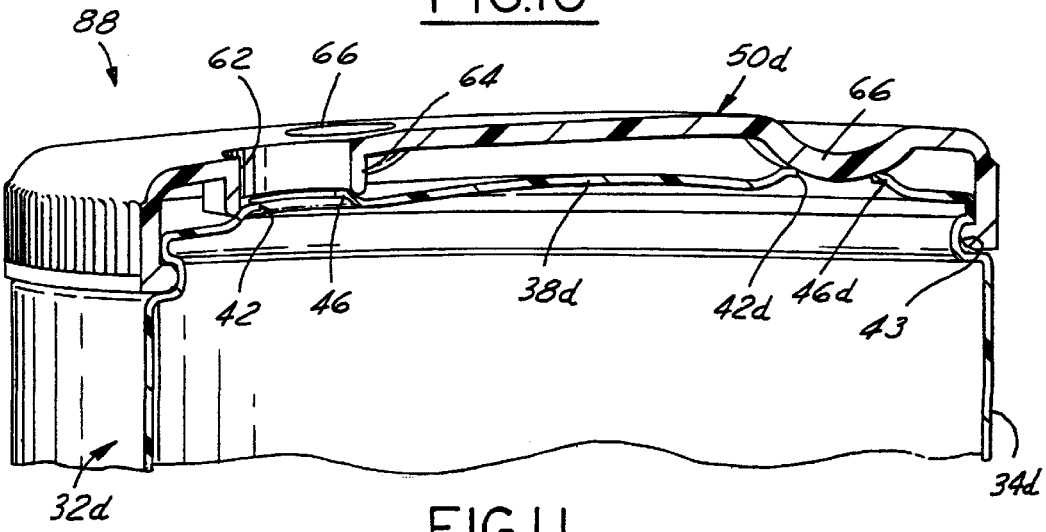
FIG. 11 is a fragmentary sectional view taken substantially along the line 11—11 in FIG. 10.

FIGS. 10–11 illustrate a dispenser package 88 in accordance with yet another embodiment of the invention. Sidewall 34*d* of container 32*d* has circumferentially continuous groove 43 as in the embodiments of FIGS. 1–5. Top wall 38*d* of container 32*d* has dispensing opening 42 on plateau 46 as in the embodiment of FIGS. 1–3A, and has a second opening 42*d* on a plateau 46*d* diametrically spaced from opening 42 and plateau 46. There is one dispensing opening 62 in closure 50*d* defined by an inwardly extending annular wall 64, and three depressions 66 at 90° spacing from each other and from opening 62. Container 32*d* does not have a center fill opening 40 as in the prior embodiments, but is filled with product through one of the offset openings 42, 42*d*. Thus, closure 50*d* can be locked in the open position illustrated in FIGS. 10 and 11 by registry of wall 64 with plateau 46 or 46*d* and the diametrically opposed depression 66 with the diametrically opposed plateau, and may be releasably locked in the closed position by registry of the other depressions 66 with the openings 42, 42*d*. Thus, package 88 has the advantage that either one of the openings 42, 42*d* can function as the dispensing opening so that, from the closed position, closure 52 can be rotated 90° in either direction for dispensing, and thereafter rotated 90 degrees in either direction to close the dispensing opening.

Figure 12:
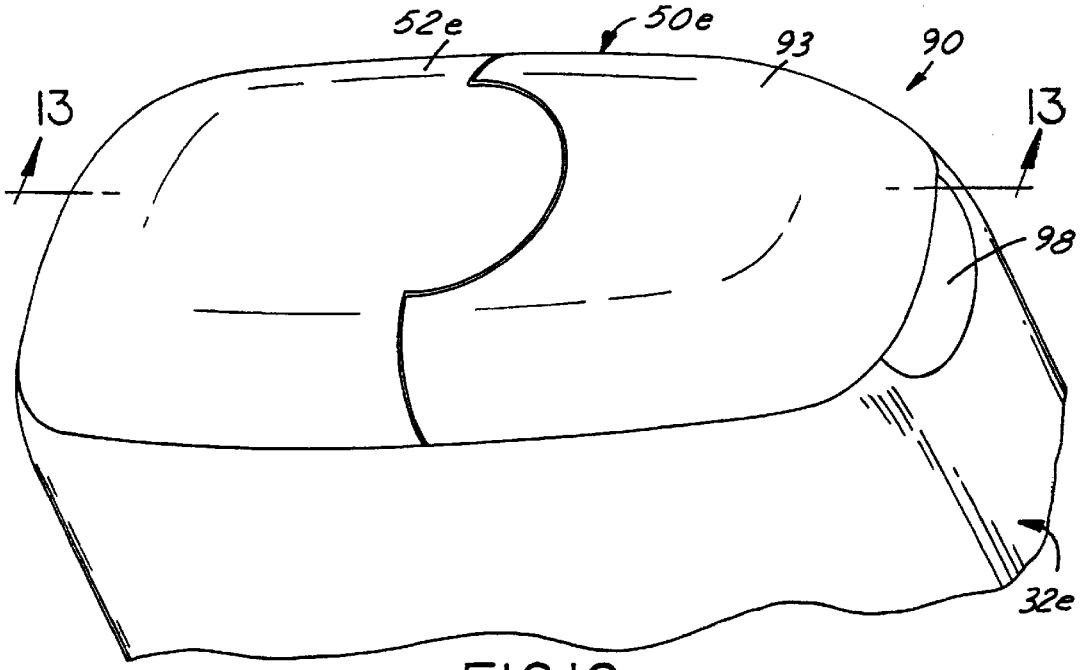
FIG. 12 is a fragmentary perspective view of a dispenser package in accordance with another embodiment of the invention.
Figure 13:
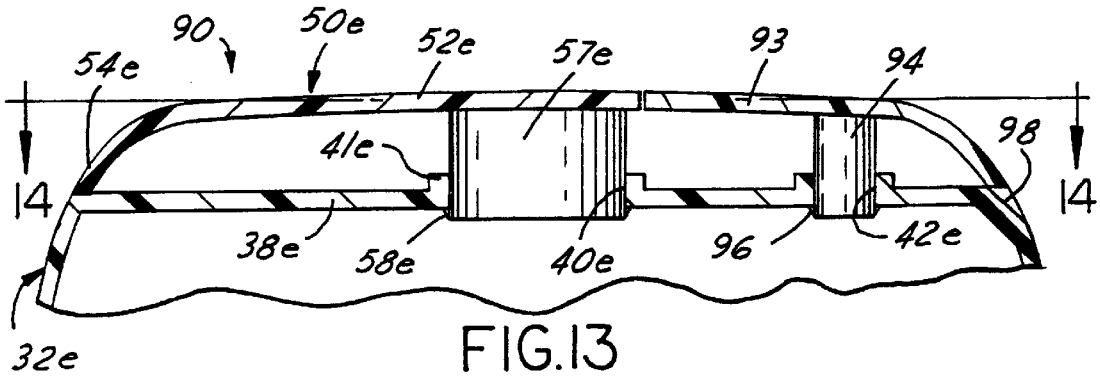
FIG. 13 is a fragmentary sectional view taken substantially along the line 13—13 in FIG. 12.
Figure 14:
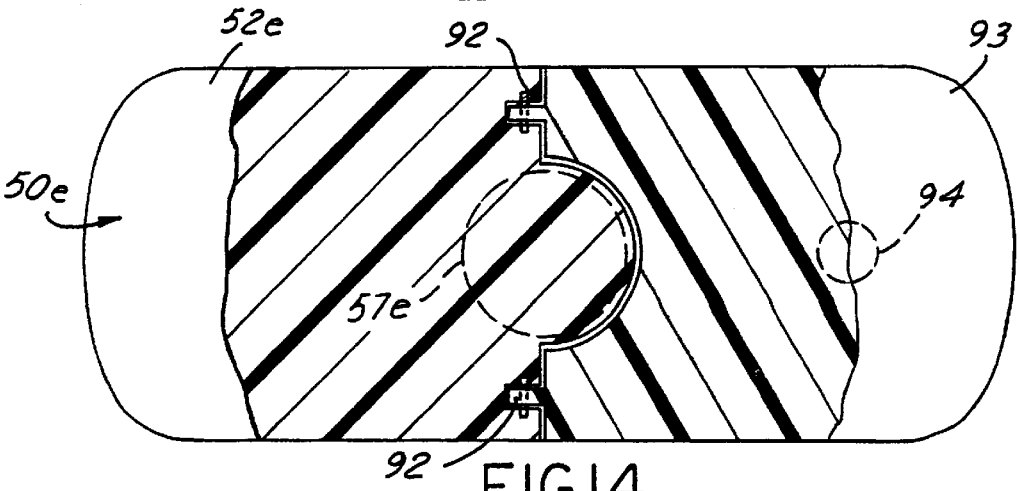
FIG. 14 is a sectional view taken substantially along the line 14—14 in FIG. 13.

FIGS. 12–21 illustrate various embodiments of the invention in which the closure comprises a flip-top closure, in which a portion is pivoted upwardly on a hinge to expose or open the dispensing opening, and thereafter pivoted downwardly about the hinge to close the dispensing opening. FIGS. 12–14 illustrate a dispenser package 90 that includes a generally oval container 32*e* and a generally oval closure 50*e*. Container 32*e* has a top wall 38*e* in which a central fill opening 40*e* is disposed. Opening 40*e* is surrounded and defined by an annular wall 41*e*. A dispensing opening 42*e* is provided in top wall 30*e* offset from the axis or centerline of container 32*e*. Closure 50*e* includes a base wall 52*e* and a peripheral skirt 54*e*. An annular wall 57*e* extends downwardly from base wall 52*e* through fill opening 40*e* in container top wall 30*e*. Wall 57*e* terminates in a radially outwardly extending rib 58*e*, which is received by snap fit in assembly through fill opening 40*e* and beneath container top wall 38*e*. A portion of top wall 52*e* and peripheral skirt 54*e* is separated from the remainder, and connected thereto by a pair of laterally spaced hinges 92 (FIG. 14). A plug 94 extends downwardly from this portion of base wall 52*e* for receipt in dispensing opening 42*e* of container top wall 30*e*. Plug 94, which may be solid or hollow, terminates in a radially outwardly extending flange 96 that is received by snap fit through dispensing opening 42*e* and locked beneath container top wall 38*e*. A depression 98 is formed in container sidewall 32*e* beneath the free edge of flip top 93, by means of which a user may release plug 94 from dispensing opening 42*e* and pivot top 93 upwardly away from a dispensing opening for use. The peripheral skirt of closure 50*e* blends with the sidewall of container 32*e*.

Figure 15:
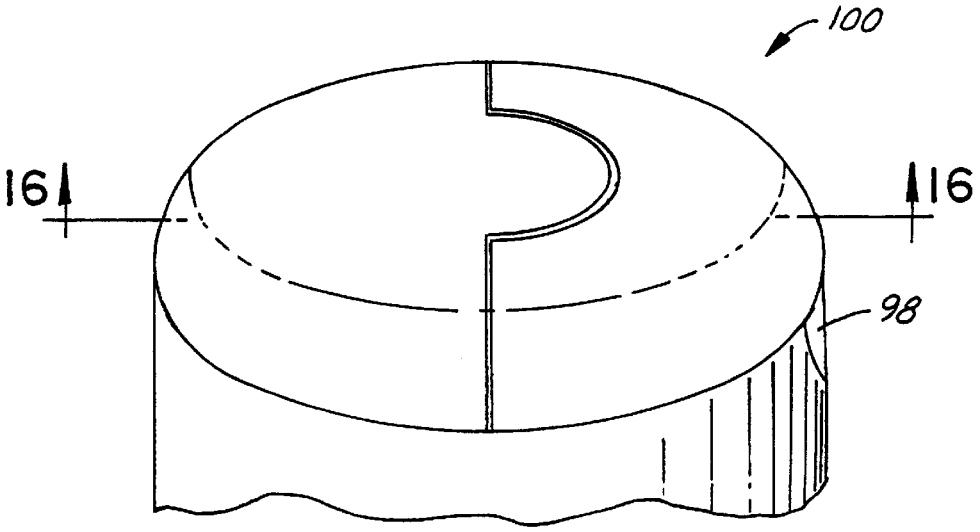
FIG. 15 is a fragmentary perspective view of a further embodiment of the invention.
Figure 16:
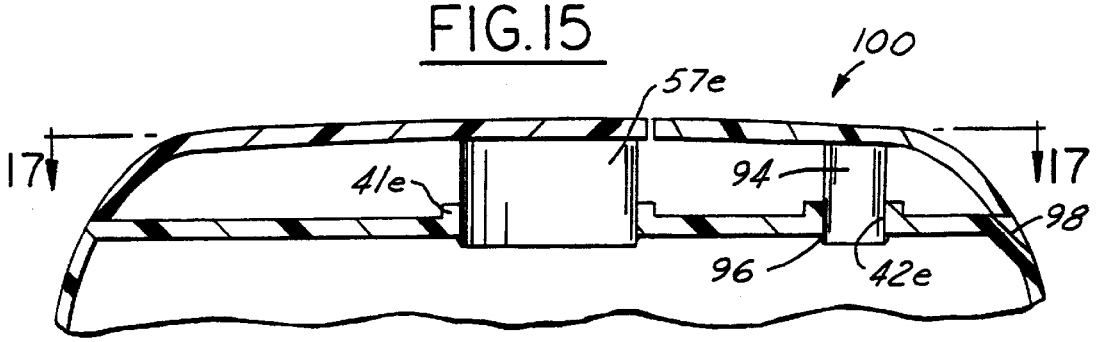
FIG. 16 is a fragmentary sectional view taken substantially along the line 16—16 in FIG. 15.
Figure 17:
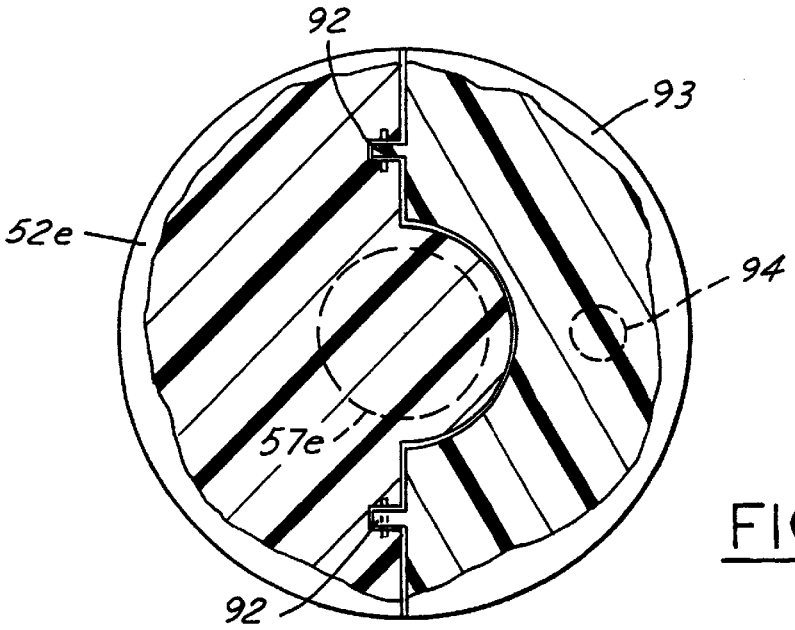
FIG. 17 is a sectional view taken substantially along the line 17—17 in FIG. 16.
Figure 18:
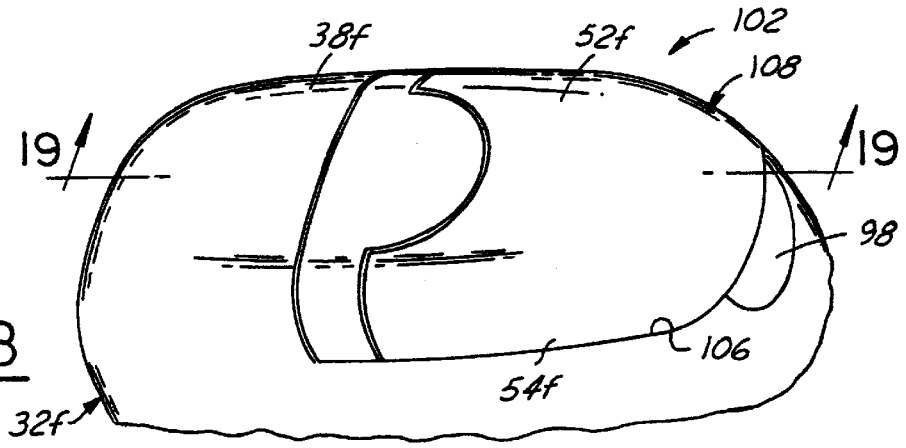
FIG. 18 is a fragmentary perspective view of another embodiment of the invention.
Figure 19:
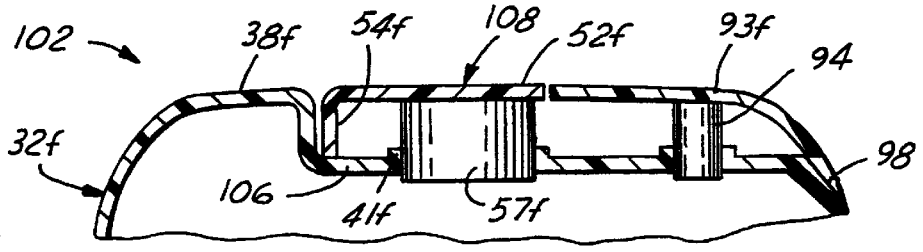
FIG. 19 is a sectional view taken substantially along the line 19—19 in FIG. 18.
Figure 20:
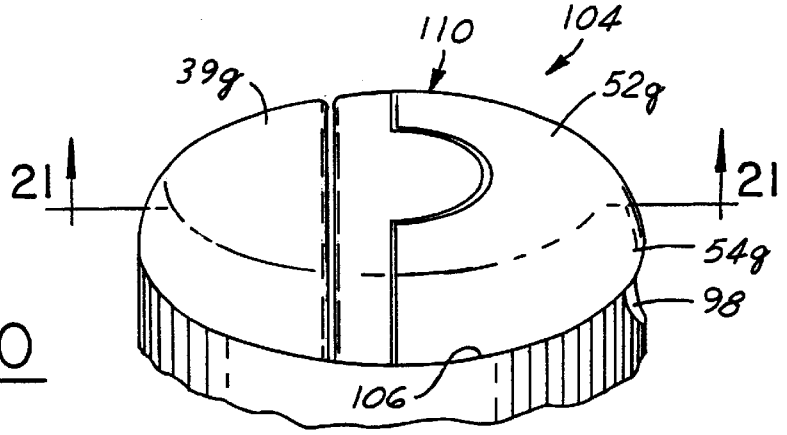
FIG. 20 is a fragmentary perspective view a further embodiment of the invention.
Figure 21:
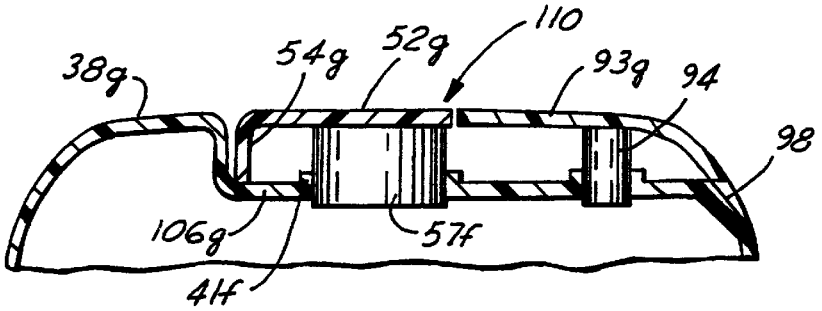
FIG. 21 is a sectional view taken substantially along the line 21—21 in FIG. 20.

FIGS. 15–17 illustrate a dispenser package 100 that is basically the same as package 90 in FIGS. 12–14, but is of circular cross section rather than oval cross section. Although pin-type hinges 92 are illustrated in FIGS. 14 and 17, it is also contemplated that integral or living hinges could be employed.

FIGS. 18–19 and 20–21 illustrate dispenser packages 102, 104 that are respectively similar to packages 90, 100 in FIGS. 12–14 and 15–17, except that the top wall of the container is stepped so as to form a recessed portion within which the closure is mounted. That is, in dispenser 102 of FIGS. 18 and 19, the top wall 38*f* of container 32*f* has a recessed portion or ledge 106 within which closure 108 is mounted so as to blend with the top wall and side wall of the container. Closure 108 includes a base wall 52*f* and a peripheral skirt 54*f*, and a flip-top portion 93*f* connected to base wall 52*f* by hinges 92 as illustrated in FIGS. 14 and 17. In the same way, closure 110 of package 104 in FIGS. 20 and 21 includes a base wall 52*g* with a peripheral skirt 54*g*, and a flip top 93*g* connected thereto by hinges. Closure 110 is seated on a ledge 106*g* formed in container top wall 38*g*. Although the embodiments of FIGS. 12–21 illustrate a telescoping snap-fit arrangement in which a wall 57*e* or 57*f* is received within an annular wall 41*e* or 41*f*, it is also contemplated in these embodiments that the closure mounting arrangement could be as at 57, 41 in FIGS. 3, 5, 7 and 9.

What is claimed is:

1. A dispenser package for a fluent product, which comprises:

an integrally molded plastic container having a flexible body with a sidewall having a central axis, a closed bottom, a top wall with at least one opening offset from said axis, and a circumferential exterior channel extending around said sidewall adjacent to said top wall, a closure having a base wall, a peripheral skirt, and a rib extending radially inwardly from said skirt for slidable receipt in said channel to mount said closure on said container for rotation about said axis, said closure having an opening for registry with said at least one opening in said top wall for dispensing product from said package, and detent means on said base wall of said closure and said top wall of said container for releasably locking said closure to said container with said opening in said closure in registry with said at least one opening in said container, said detent means comprising a second opening in said top wall angularly spaced from said at least one opening, and a lug on said base wall angularly spaced from said opening in said closure for registry with said second opening in said top wall when said opening in said closure registers with said at least one opening in said top wall.

2. The package set forth in claim 1 wherein said at least one opening and said second opening in said top wall are at equal radial offset from said axis, such that said lug on said closure is constructed to cooperate with said at least one opening in said top wall for releasably locking said closure to said container with said opening in said closure out of registry with said at least one opening in said top wall.

3. The package set forth in claim 2 wherein said lug on said closure comprises a depression in said base wall.

4. The package set forth in claim 3 wherein said base wall includes a plurality of said depressions for releasably locking said closure to said container in a plurality of angularly spaced positions.

5. A dispenser package for a fluent product, which comprises:

an integrally molded plastic container having a flexible body with a sidewall having a central axis, a closed bottom, a top wall with at least one opening offset from said axis, and a circumferential exterior channel extending around said sidewall adjacent to said top wall, a closure having a base wall, a peripheral skirt, and a rib extending radially inwardly from said skirt for slidable receipt in said channel to mount said closure on said container for rotation about said axis, said closure having an opening for registry with said at least one opening in said top wall for dispensing product from said package, and detent means on said base wall of said closure and said top wall of said container for releasably locking said closure to said container with said opening in said closure in registry with said opening in said container, said detent means comprising an elevated plateau on said top wall of said container surrounding said at least one opening, and an annular collar on said closure base wall surrounding said opening in said closure for releasable locking registry with said plateau.

6. The package set forth in claim 5 wherein said plateau has an angulated sidewall for camming said collar into and out of registry with said plateau as said closure is rotated on said container.

7. The package set forth in claim 6 wherein said collar has a rounded edge remote from said base wall.

8. The package set forth in claim 7 wherein said closure has a lug that extends from said base wall angularly spaced from said at least one opening for releasable locking engagement with said opening in said top wall to lock said closure to said container with said at least one opening in said top wall and said opening in said base wall out of registry.

9. The package set forth in claim 8 wherein said lug on said closure comprises a depression in said base wall.

10. A dispenser package for a fluent product, which comprises:

an integrally molded plastic container having a flexible body with a sidewall having a central axis, a closed bottom, a top wall with at least one opening offset from said axis, and an opening centered on said axis that is of larger diameter than said at least one opening offset from said axis, said central opening being surrounded by a wall that extends axially from said top wall terminating in a radial bead, and a circumferential exterior channel extending around said sidewall adjacent to said top wall, and a closure having a base wall that has an axially and radially inwardly extending bead for slide receipt by snap fit over said radial bead on said top wall, a peripheral skirt, and a rib extending radially inwardly from said skirt for slidable receipt in said channel to mount said closure on said container for rotation about said axis, said closure having an opening for registry with said at least one opening in said top wall for dispensing product from said package.

11. The package set forth in claim 10 wherein said closure base wall further includes an annular wall spaced radially inwardly from said bead for sliding internal receipt within said axial wall on said top wall.

12. The package set forth in claim 1, 5 or 10 further comprising a check valve mounted in said at least one opening in said top wall.

13. The package set forth in claim 1, 5 or 10 wherein said opening in said closure base wall comprises an axial portion for registry with said at least one opening in said container top wall, and a radial portion that extends through said base wall to said skirt.

14. The package set forth in claim 1, 5 or 10 further comprising a circumferential array of outer surface ribs extending around said peripheral skirt to facilitate rotation of said closure on said container.

15. A dispenser package for a fluent product, which comprises:

an integrally molded plastic container having a flexible body with a sidewall having a central axis, a closed bottom and a top wall having a first opening centered on said axis and at least one second opening offset from said axis, and a closure that has a base wall and a peripheral skirt, said base wall having an annular axially extending wall with interlocking means for engaging said first opening in said top wall to mount said closure on said container, and means for selectively opening and closing said at least one opening in said container, said first opening in said container being surrounded by an annular wall that extends axially from said top wall and a radial bead that extends radially outwardly from said annular wall, and said interlocking means comprising a radially inwardly extending bead on said annular axially extending wall of said closure for receipt over said bead on said top wall.

16. The package set forth in claim 15 wherein said closure has a second annular wall of a diameter for close fit within said annular wall on said top wall.

17. A dispenser package for a fluent product, which comprises:

an integrally molded plastic container having a flexible body with a sidewall having a central axis, a closed bottom and a top wall having a first opening centered on said axis and at least one second opening offset from said axis, and a closure that has a base wall and a peripheral skirt, said base wall having an annular axially extending wall with interlocking means for engaging said first opening in said top wall to mount said closure on said container, and means for selectively opening and closing said at least one opening in said container, said closure being non-rotatably mounted on said container, and said selectively opening means comprising a flip top hinged to said closure.

18. The package set forth in claim 17 wherein said flip top has a plug for internal sealing registry with said second opening in said container when said flip top is closed.

19. The package set forth in claim 17 wherein said interlocking means comprises a radially outwardly extending rib on said annular axially extending wall for snap-fit receipt through said first opening in said top wall.

20. The package set forth in claim 17 wherein said container top wall has a recessed portion in which said first opening, said second openings and said closure are disposed.

21. A dispenser package for a fluent product, which comprises:

an integrally molded plastic container having a flexible body with a sidewall having a central axis, a closed bottom and a top wall having a first opening centered on said axis and at least one second opening offset from said axis, and a closure that has a base wall and a peripheral skirt, said base wall having an annular axially extending wall with interlocking means for engaging said first opening in said top wall to mount said closure on said container, and means for selectively opening and closing said at least one opening in said container, said closure being rotatably mounted on said container, and said selectively opening means comprising an opening in said base wall offset from said axis for selective registry with said second opening in said top wall.

22. The package set forth in claim 21 further comprising detent means on said base wall of said closure and said top wall of said container for releasably locking said closure to said container with said opening in said closure in registry with said opening in said container.

23. The package set forth in claim 22 wherein said detent means comprises an elevated plateau on said top wall of said container surrounding said at least one opening, and an annular collar on said closure top wall for releasable locking registry with said plateau.

24. The package set forth in claim 23 wherein said plateau has an angulated sidewall for camming said collar into and out of registry with said plateau as said closure is rotated on said container.

25. The package set forth in claim 24 wherein said collar has an edge remote from said base wall.

26. The package set forth in claim 25 wherein said closure has a lug that extends from said base wall angularly spaced from said at least one opening for releasable locking engagement with said opening in said top wall to lock said closure to said container with said at least one opening in said top wall and said opening in said base wall out of registry.

27. The package set forth in claim 26 wherein said lug on said closure comprises a depression in said base wall.

28. The package set forth in claim 22 wherein said detent means comprises a second opening in said top wall angularly spaced from said at least one opening, and a lug on said base wall angularly spaced from said opening in said closure for registry with said second opening in said top wall when said opening in said closure registers with said at least one opening in said top wall.

29. The package set forth in claim 28 wherein said at least one opening and said second opening in said top wall are at equal radial offset from said axis, such that said lug on said closure is constructed to cooperate with said at least one opening in said top wall for releasibly locking said closure to said container with said opening in said closure out of registry with said at least one opening in said top wall.

30. The package set forth in claim 29 wherein said lug on said closure comprises a depression in said base wall.

31. The package set forth in claim 30 wherein said base wall includes a plurality of said depressions for releasably locking said closure to said container in a plurality of angularly spaced positions.

32. An integrally molded plastic container having a flexible body with a sidewall having a central axis, a closed bottom, a top wall with at least one opening offset from said axis and an opening centered on said axis that is of larger diameter than said at least one opening offset from said axis, and a circumferential exterior radially outwardly opening channel extending around said sidewall adjacent to said top wall, said central opening being surrounded by a wall that extends axially from said top wall terminating in a radial bead.

33. The container set forth in claim 32 wherein said central opening is surrounded by a wall that extends axially outwardly from said top wall terminating in a radial bead.

34. The container set forth in claim 32 further comprising a check valve mounted in said at least one opening in said top wall.

35. A closure having a base wall, a peripheral skirt, a rib extending radially inwardly from said skirt, a dispensing opening in said base wall, and detent means on said base wall comprising a lug on said base wall angularly spaced from said dispensing opening.

36. The closure set forth in claim 35 wherein said lug on said closure comprises a depression in said base wall.

37. The closure set forth in claim 36 wherein said base wall includes a plurality of said depressions angularly spaced from each other around a common axis.

38. A closure having a base wall, a peripheral skirt, a rib extending radially inwardly from said skirt, a dispensing opening in said base wall, and detent means on said base wall comprising an annular collar on said closure base wall surrounding said dispensing opening.

39. The closure set forth in claim 38 wherein said collar has a rounded edge remote from said base wall.

40. The closure set forth in claim 39 wherein said closure has a lug that extends from said base wall angularly spaced from said at least one opening around a common axis.

41. The closure set forth in claim 40 wherein said lug on said closure comprises a depression in said base wall.

42. The closure set forth in claim 35 or 38 wherein said opening in said closure base wall comprises an axial portion and a radial portion that extends through said base wall to said skirt.

43. The closure set forth in claim 35 or 38 further comprising a circumferential array of outer surface ribs extending around said peripheral skirt to facilitate rotation of said closure.

44. An integrally molded plastic container having a flexible body with a sidewall having a central axis, a closed bottom and a top wall having a first opening centered on said axis and at least one second opening offset from said axis, said first opening in said container being surrounded by an annular wall that extends axially outwardly from said top wall and a radial bead that extends outwardly from said annular wall.

45. The container set forth in claim 44 wherein said container top wall has a recessed portion in which said first opening is disposed.

46. The container set forth in claim 44 further comprising detent means on said top wall of said container for releasably locking a closure to said container with an opening in the closure in registry with said opening in said container.

47. The container set forth in claim 46 wherein said detent means comprises an elevated plateau on said top wall of said container surrounding said at least one opening.

48. The container set forth in claim 47 wherein said plateau has an angulated sidewall.

49. The container set forth in claim 46 wherein said detent means comprises a second opening in said top wall angularly spaced from said at least one opening.

50. The container set forth in claim 49 wherein said at least one opening and said second opening in said top wall are at equal radial offset from said axis.

51. A closure that has a base wall and a peripheral skirt, said base wall having an annular axially extending wall spaced radially inwardly from said peripheral skirt with interlocking means on said axially extending wall for engaging an opening in a top wall of a container to mount said closure on the container, and means for selectively opening and closing a dispensing opening in the container, said interlocking means comprising a radially inwardly extending bead at an end of said annular axially extending wall remote from said base wall.

52. The closure set forth in claim 51 wherein said selectively opening means comprises a flip top hinged to said closure.

53. The closure set forth in claim 52 wherein said flip top has a plug for internal sealing registry with the dispensing opening in the container when said flip top is closed.

* * * * *